US010344506B2

(12) United States Patent
Hernandez et al.

(10) Patent No.: US 10,344,506 B2
(45) Date of Patent: Jul. 9, 2019

(54) LATCH HOUSING AND METHOD FOR ISOLATING COMPONENTS IN A LATCH HOUSING

(71) Applicants: Cecilia Hernandez, Cd. Juarez, Chih. (MX); Roberto Hernandez, Cd. Juarez, Chih. (MX)

(72) Inventors: Cecilia Hernandez, Cd. Juarez, Chih. (MX); Roberto Hernandez, Cd. Juarez, Chih. (MX)

(73) Assignee: INTEVA PRODUCTS, LLC, Troy, MI (US)

( * ) Notice: Subject to any disclaimer, the term of this patent is extended or adjusted under 35 U.S.C. 154(b) by 339 days.

(21) Appl. No.: 14/456,882

(22) Filed: Aug. 11, 2014

(65) Prior Publication Data

US 2015/0042104 A1 Feb. 12, 2015

Related U.S. Application Data

(60) Provisional application No. 61/864,872, filed on Aug. 12, 2013.

(51) Int. Cl.

| | |
|---|---|
| ***E05B 81/24*** | (2014.01) |
| ***E05B 85/02*** | (2014.01) |
| *E05B 77/34* | (2014.01) |
| *E05B 81/06* | (2014.01) |
| *E05B 81/34* | (2014.01) |

(52) U.S. Cl.

CPC ..... *E05B 81/24* (2013.01); *E05B 85/02* (2013.01); *E05B 77/34* (2013.01); *E05B 81/06* (2013.01); *E05B 81/34* (2013.01); *Y10T 29/49826* (2015.01); *Y10T 292/08* (2015.04)

(58) Field of Classification Search

CPC ..... Y10T 292/1082; Y10T 292/699; E05B 85/02; E05B 77/34; E05B 77/28; E05B 9/00; Y10S 292/38; Y10S 292/64

USPC ..... 292/2, 216, 201

See application file for complete search history.

(56) References Cited

U.S. PATENT DOCUMENTS

| | | | | |
|---|---|---|---|---|
| 3,969,789 A | | 7/1976 | Wize | |
| 5,678,869 A | * | 10/1997 | Yoshikuwa | E05B 81/66 292/216 |
| 5,909,918 A | * | 6/1999 | Kowalewski | E05B 81/06 292/142 |
| 6,232,684 B1 | * | 5/2001 | Haag | E05B 81/06 292/201 |
| 6,349,983 B1 | * | 2/2002 | Dupont | E05B 81/14 292/201 |
| 6,568,741 B1 | | 5/2003 | Leung et al. | |

(Continued)

*Primary Examiner* — Mark A Williams

(74) *Attorney, Agent, or Firm* — Cantor Colburn LLP

(57) ABSTRACT

A latch assembly is disclosed herein. The latch assembly having: a latch mechanism; an actuator assembly, the actuator assembly, comprising a housing, a cover configured to be secured to the housing, and a plurality of barriers located within peripheral edges of the housing, wherein the plurality of barriers extended upwardly from a bottom surface of the housing and terminate at an edge portion wherein the housing cover is configured to contact the edge portion of the plurality of barriers when the cover is secured to the housing and wherein the plurality of barriers are configured to mitigate dust intrusion towards components of the actuator assembly.

12 Claims, 4 Drawing Sheets

(56) References Cited

U.S. PATENT DOCUMENTS

| | | | | |
|---|---|---|---|---|
| 6,608,265 | B2 * | 8/2003 | Shinkawa | H01H 3/163 200/293 |
| 6,679,531 | B2 | 1/2004 | Rogers, Jr. et al. | |
| 8,348,310 | B2 | 1/2013 | Vazquez et al. | |
| 10,000,949 | B2 | 6/2018 | Vazquez et al. | |
| 2002/0167177 | A1 * | 11/2002 | Erices | E05B 77/04 292/201 |
| 2008/0196707 | A1 * | 8/2008 | Chirumbolo | E05B 15/101 126/197 |
| 2010/0127512 | A1 | 5/2010 | Vazquez et al. | |
| 2011/0204659 | A1 | 8/2011 | Estrada et al. | |
| 2012/0292927 | A1 | 11/2012 | Vazquez et al. | |
| 2013/0214543 | A1 * | 8/2013 | Rice | E05B 77/00 292/97 |
| 2015/0145262 | A1 * | 5/2015 | Gotzen | E05B 77/10 292/194 |
| 2015/0233150 | A1 * | 8/2015 | Mittelbach | E05B 81/06 292/201 |
| 2015/0233151 | A1 * | 8/2015 | Mittelbach | E05B 85/00 70/91 |
| 2015/0233452 | A1 * | 8/2015 | Martinez | E05B 81/25 74/89.14 |

* cited by examiner

LATCH HOUSING AND METHOD FOR ISOLATING COMPONENTS IN A LATCH HOUSING

CROSS REFERENCE TO RELATED APPLICATION

This application claims the benefit of U.S. Provisional Patent Application No. 61/864,872 filed Aug. 12, 2013, the contents of which are incorporated herein by reference thereto.

BACKGROUND

Vehicle side door latches incorporate one or more electromechanical actuators to accomplish electromechanical functions such as power lock/unlock, power child security, power release or double locking, etc. The extreme environments a side door latch is exposed can inhibit the performance and durability of such electromechanical actuators. In particular, one of the environmental conditions a side door latch may be exposed to is dust having a small particulate size or fine road dust. The intrusion of this dust into the latch assembly can have a pronounced effect on the performance and longevity of the electromechanical actuators. The dust coupled with the grease used in the latch assembly can potentially create excessive friction between the components of the latch assembly.

Accordingly, it is desirable to provide a latch assembly and/or latch housing or actuator housing that inhibits the intrusion of dust and other particulates into the latch assembly or actuator assembly.

SUMMARY OF THE INVENTION

In one non-limiting embodiment, a latch assembly is provided. The latch assembly having: a latch mechanism; an actuator assembly, the actuator assembly, comprising a housing, a cover configured to be secured to the housing, and a plurality of barriers located within peripheral edges of the housing, wherein the plurality of barriers extended upwardly from a bottom surface of the housing and terminate at an edge portion wherein the housing cover is configured to contact the edge portion of the plurality of barriers when the cover is secured to the housing and wherein the plurality of barriers are configured to mitigate dust intrusion towards components of the actuator assembly.

In another embodiment, a housing for an actuator assembly configured to be secured to a latch mechanism of a latch assembly is provided. The housing having: a lower housing portion; a cover configured to be secured to the lower housing; and a plurality of barriers located within peripheral edges of the lower housing portion, wherein the plurality of barriers extended upwardly from a bottom surface of the lower housing portion and terminate at an edge portion wherein the housing cover is configured to contact the edge portion of the plurality of barriers when the cover is secured to the lower housing portion and wherein the plurality of barriers are configured to mitigate dust intrusion towards components of the actuator assembly.

In yet another embodiment, a method of limiting dust and debris intrusion into a housing for an actuator assembly configured to be secured to a latch mechanism of a latch assembly is provided. The method including the steps of: locating a plurality of components of the latch assembly into a lower housing portion of the housing; securing a cover to the lower housing portion, wherein the cover is configured to be secured to the lower housing portion and wherein the lower housing portion has a plurality of barriers located within peripheral edges of the lower housing portion, wherein the plurality of barriers extended upwardly from a bottom surface of the lower housing portion and terminate at an edge portion wherein the housing cover is configured to contact the edge portion of the plurality of barriers when the cover is secured to the lower housing portion and wherein the plurality of barriers are configured to mitigate dust intrusion towards components of the actuator assembly.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Referring now to the FIGS. various embodiments of the invention will be described with reference to specific embodiments, without limiting same, the attached FIGS. shows portions of a latch or latch assembly 10.

In the exemplary embodiment shown, latch or latch assembly 10 is a side door latch. Still further the latch or latch assembly 10 can be used with any vehicle door or component.

For example, the latch or latch assembly 10 is applicable to any environment where the features of various embodiments of the invention are desired. For example, the latch assembly 10 can be attached to a vehicle structure such that a fork bolt or claw of the latch assembly is moved between an open position and a closed position when a hood, door, window, lift gate, etc. is opened and closed and the fork bolt or claw engages a striker that is attached to the hood, door, window, lift gate, etc.

Alternatively, the latch 10 or latch assembly 10 can be secured to the hood, door, window, lift gate, etc. and the striker is secured to the vehicle body at an opening into which the hood, door, window, lift gate, etc. is received.

Figure 1:
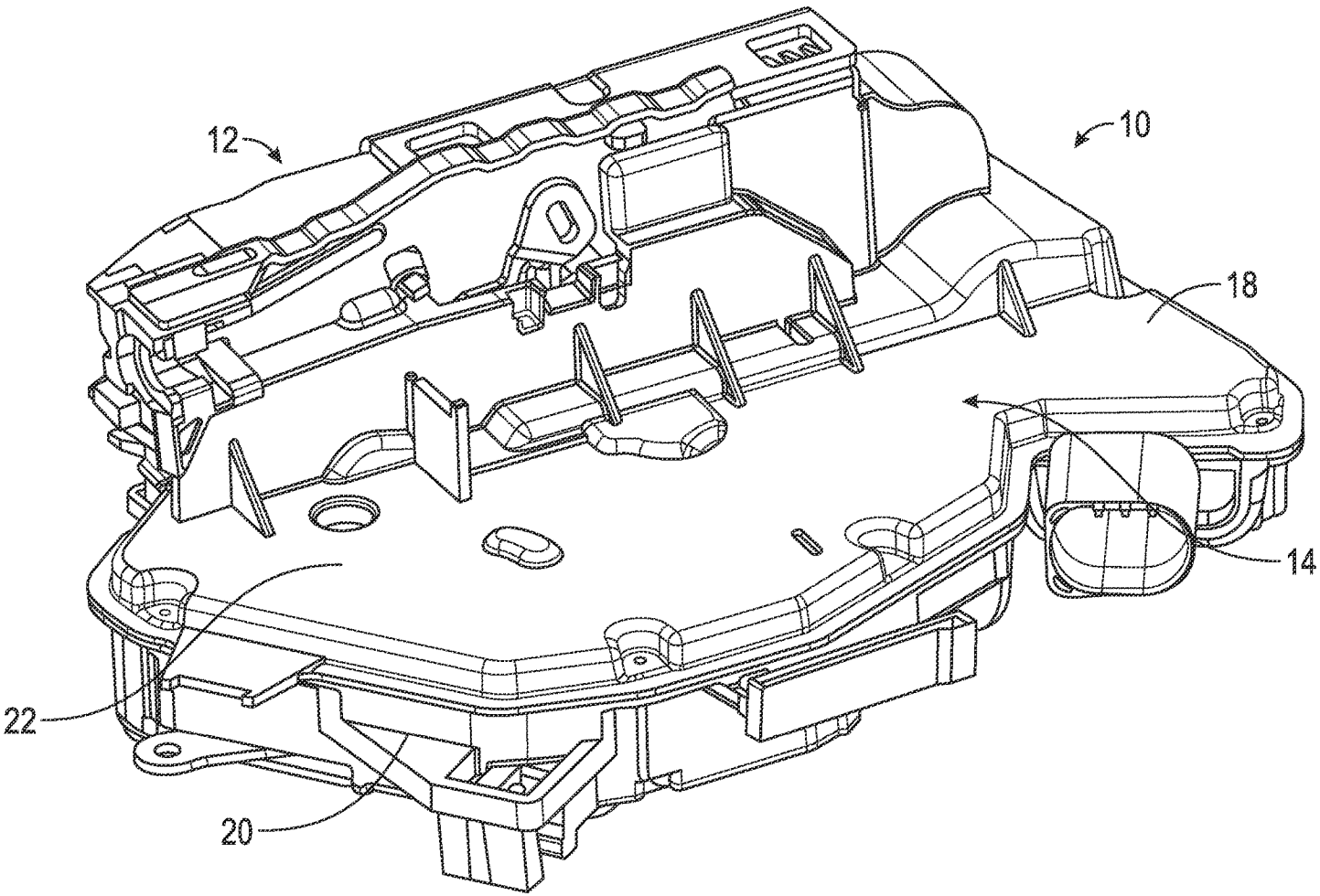
FIG. 1 is a perspective view of a latch assembly in accordance with a non-limiting embodiment of the present invention.

As illustrated in FIG. 1 the latch or latch assembly 10 has a latch mechanism 12. The latch mechanism 12 includes a fork bolt or claw and a detent lever or pawl (which are not viewable as they are located within the housing of the latch mechanism 12) each of which may be pivotally or movably mounted to a housing or another portion or housing of the latch mechanism 12 of latch assembly 10.

As mentioned above, an actuator assembly 14 is configured to cooperate with the latch mechanism in order to perform the desired movements of the components (e.g., fork bolt or claw and detent lever or pawl, etc.) or allow for (e.g., unlock) the desired movements of the components or prevent (e.g., lock) movement of the components as is known in the related arts. The actuator assembly 14 will have a plurality of electromechanical actuators and components 16. As mentioned above, it is desirable to isolate these electromechanical actuators and components 16 from dust and debris that the latch assembly 10 is exposed to.

Figure 2:
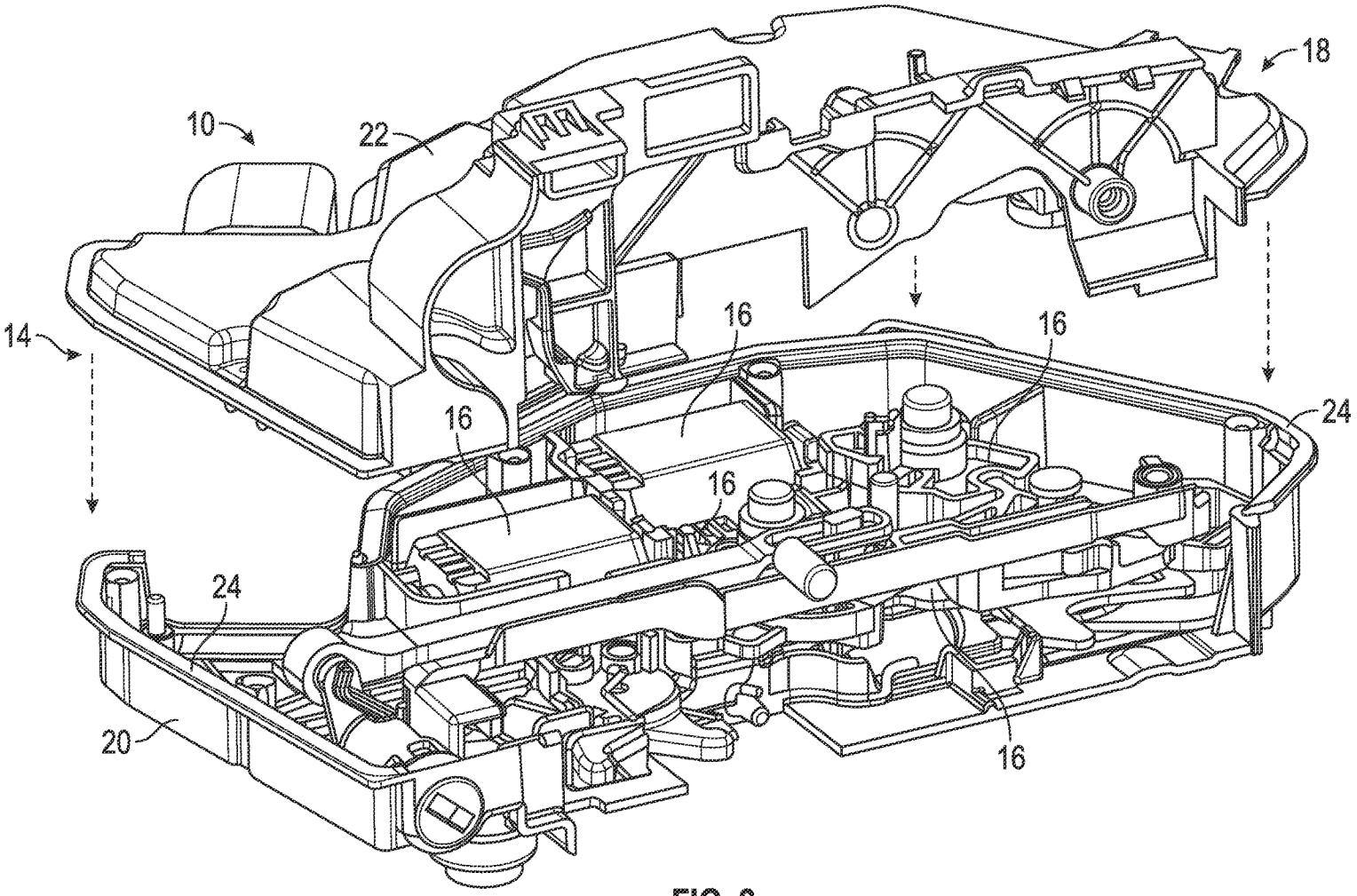
FIG. 2 is an opposite exploded perspective view of the actuator assembly of the latch assembly illustrated in FIG. 1, wherein the latch mechanism has been removed.

FIG. 1 illustrates the latch mechanism 12 secured to the actuator assembly 14. FIG. 2, is an opposite perspective view of the latch assembly 10 illustrated in FIG. 1 with the latch mechanism 12 removed.

The actuator assembly 14 further comprises an enclosure or housing 18 having a housing or a lower housing portion 20 and an associated cover 22. The housing 20 provides protection from the elements and a mounting location for all of the components 16 that make up the actuator or actuator assembly. Housing 20 also provides a mounting surface 24 for the actuator cover 22 to be secured to. Once the actuator cover 22 is secured the housing 20 a complete enclosure for all of the components of the actuator assembly 14 is provided.

The components 16 may include, but are not limited to an inside release lever, outside release lever, studs, switches, electronic component carriers (ECC) and/or assemblies, motors and gear train(s) each of which may be mounted and held in position and separated by a plurality of walls or barriers 26 that are located within the actuator housing 20.

In one embodiment, the plurality of barriers or walls 26 may be located within peripheral edges 28 of the housing 20. In one implementation, the plurality of barriers 26 may extend upwardly from a bottom surface 30 of the housing and terminate at an edge portion 32. In this configuration, the housing cover 22 is configured to contact the edge portion 32 of the plurality of barriers 26 when the cover 22 is secured to the housing thus, creating a plurality of sealed separate chambers 36.

Figure 3:
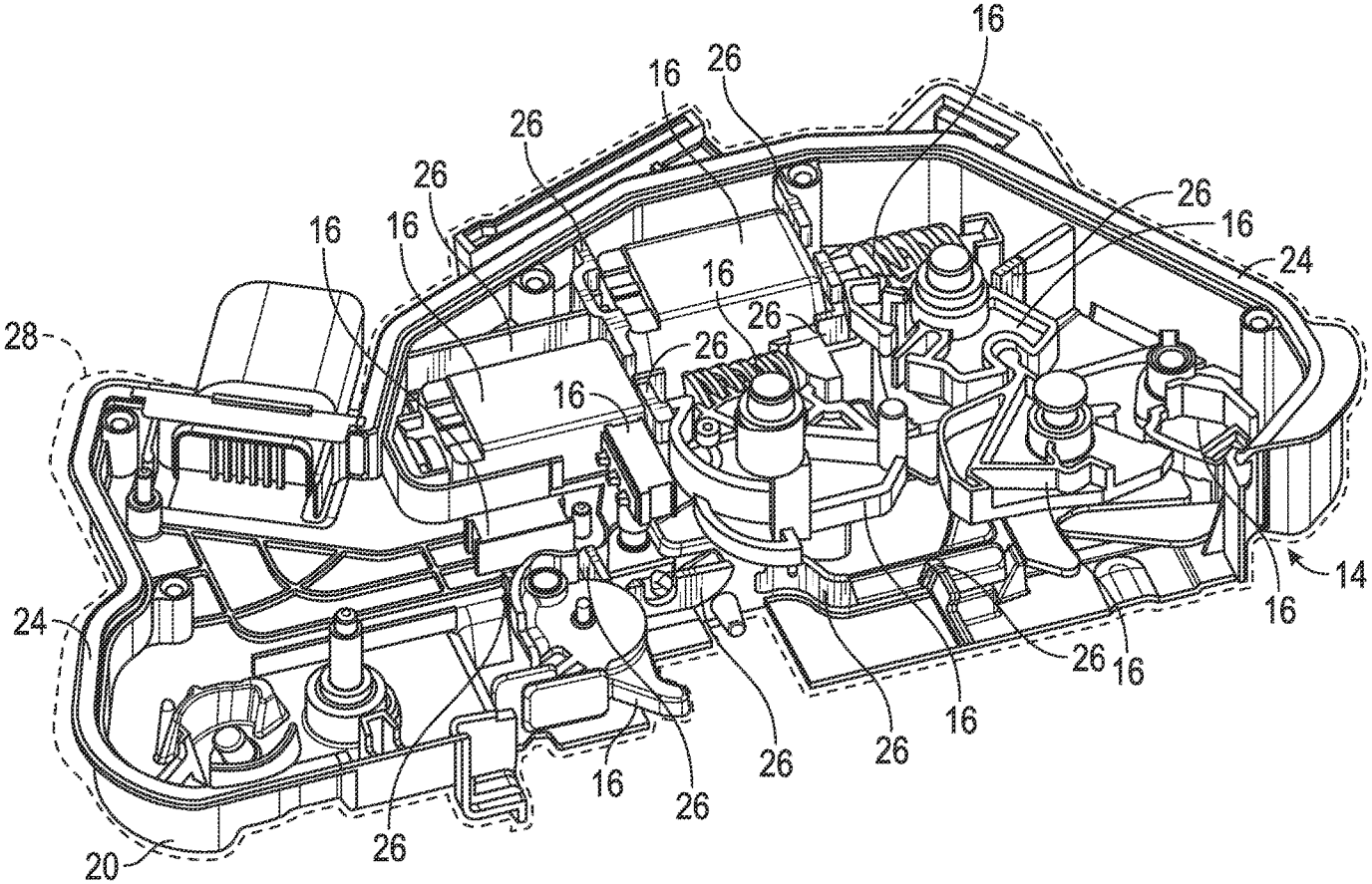
FIGS. 3 and 4 are top perspective views of a housing contemplated for use with the actuator assembly illustrated in FIGS. 1 and 2.
Figure 4:
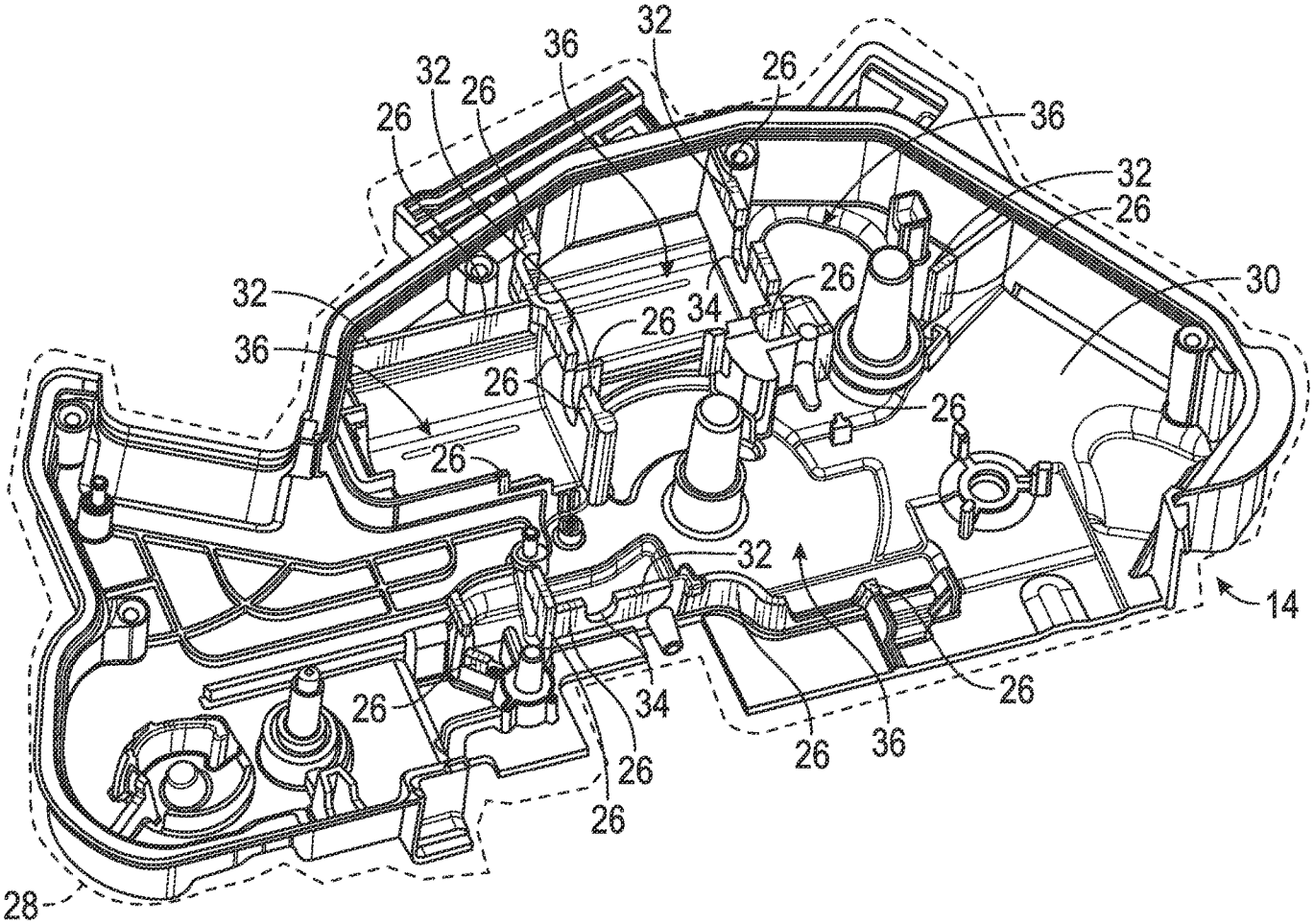

FIG. 3 illustrates the housing or lower housing portion 20 of the actuator assembly with the plurality of components 16 and FIG. 4 illustrates the housing or lower housing portion 20 of the actuator assembly without the plurality of components 16. In addition and as illustrated in FIGS. 3 and 4, the plurality of barriers 26 are illustrated with shading.

In one embodiment, some of the plurality of barriers 26 may have an opening or feature 34 that allows a portion of some of the components 16 to pass therethough in order to provide operational features of the actuator assembly 14. Of course, it is understood that a plurality of barriers 26 may be configured without openings or features 34.

In accordance with an exemplary embodiment, the clearances between the actuator housing barriers 26 and the actuator cover 22 may be reduced and/or eliminated and the clearances between the actuator barriers 26 and the components 16 of the actuator assembly 14 may be minimized in order to inhibit dust or debris from coming into contact with the components 16 of the actuator assembly 14. In addition, the barriers 26 and/or the housing itself may be configured to include additional details or features configured to block out dust.

Accordingly, the housing 20 in conjunction with the plurality of barriers 26 and cover 22 provide sealed separate chambers 36, where possible, for components 16 of the actuator assembly 14. These sealed separate chambers 36 prevent dust intrusion into the components 16 of the actuator assembly 14.

In one exemplary embodiment, the mounting surfaces, and housing barriers are added to minimize clearances between the barriers and components in order to minimize dust intrusion. This also isolates components such as but not limited to gear mechanisms and/or electric mechanisms from dust and debris intrusion.

While specific configurations are illustrated in the attached FIGS. it is, of course, understood that various embodiments of the present invention may be directed to alternative configurations not specifically disclosed in the attached FIGS. For example, the configurations of the plurality of barriers 26 may be varied from those specifically illustrated in the attached FIGS. as numerous configurations are contemplated with be within the scope of various embodiments of the present invention and/or the housing or enclosure 18 may have numerous alternative configurations.

Reference is made to the following U.S. Pat. Nos. 3,969,789; 6,568,741; 6,679,531; 8,348,310 and U.S. Patent Publication Nos. US 2010/0127512; US 2011/0204659; US 2012/0292927 and provisional Patent Application Ser. No. 61/806,530 filed Mar. 29, 2013, the entire contents each of which are incorporated herein by reference thereto, which illustrate latch mechanisms that may be used with the actuator assembly 14 and housing disclosed herein.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

What is claimed is:

1. A latch assembly, comprising:

a latch mechanism;

an actuator assembly, the actuator assembly, comprising a housing, a cover configured to be secured to the housing, and a plurality of separate walls located within peripheral edges of the housing and at separate locations within the peripheral edges of the housing such that the plurality of separate walls do not contact each other, wherein each of the plurality of separate walls extended upwardly from a bottom surface of the housing and terminate at an edge portion wherein the housing cover contacts the edge portion of each of the plurality of separate walls when the cover is secured to the housing and wherein the plurality of separate walls are configured to mitigate dust intrusion towards components of the actuator assembly and wherein the components include at least two motors each of which are held in position and separated by the plurality of separate walls.

2. The latch assembly as in claim 1, wherein the components of the actuator assembly further include anyone of the following: an inside release lever, an outside release lever, studs, and gear train(s) each of which is mounted and held in position and separated by the plurality of separate walls.

3. The latch assembly as in claim 1, wherein the components are a plurality of components and at least one of the plurality of components of the actuator assembly is located within a receiving area partially defined by a first portion of the plurality of separate walls and wherein a clearance between the at least one of the plurality of components and the first portion of the plurality of separate walls is minimized.

4. The latch assembly as in claim 3, wherein at least one of the first portion of the plurality of separate walls is configured to allow a portion of the at least one of the plurality of components to extend therethrough.

5. The latch assembly as in claim 4, wherein the housing and the cover are formed from a plastic.

6. The latch assembly as in claim 5, wherein the components of the actuator assembly further include anyone of the following: an inside release lever, an outside release lever, studs, and gear train(s) each of which may be mounted and held in position and separated by the plurality of separate walls.

7. A housing for an actuator assembly configured to be secured to a latch mechanism of a latch assembly, the housing comprising:

a lower housing portion;

a cover configured to be secured to the lower housing; and a plurality of separate walls located within peripheral edges of the lower housing portion and at separate locations within the peripheral edges of the housing such that the plurality of separate walls do not contact each other, wherein each of the plurality of separate walls extended upwardly from a bottom surface of the lower housing portion and terminate at an edge portion wherein the housing cover is contacts the edge portion of the plurality of separate walls when the cover is secured to the lower housing portion and wherein the plurality of separate walls are configured to mitigate dust intrusion towards components of the actuator assembly and wherein the components include at least two motors each of which are held in position and separated by the plurality of separate walls.

8. The housing as in claim 7, wherein the components of the actuator assembly further include anyone of the following: an inside release lever, an outside release lever, studs, and gear train(s) each of which is mounted and held in position and separated by the plurality of separate walls.

9. The housing as in claim 7, wherein the components are a plurality of components and at least one of the plurality of components of the actuator assembly is located within a receiving area partially defined by a first portion of the plurality of separate walls and wherein a clearance between the at least one of the plurality of components and the first portion of the plurality of separate walls is minimized.

10. The housing as in claim 9, wherein at least one of the first portion of the plurality of separate walls is configured to allow a portion of the at least one of the plurality of components to extend therethrough.

11. The housing as in claim 10, wherein the housing and the cover are formed from a plastic.

12. The housing as in claim 11, wherein the components of the actuator assembly further include anyone of the following: an inside release lever, an outside release lever, studs, and gear train(s) each of which may be mounted and held in position and separated by the plurality of separate walls.

* * * * *